US008093539B2

(12) United States Patent
Rastegar

(10) Patent No.: US 8,093,539 B2
(45) Date of Patent: Jan. 10, 2012

(54) INTEGRATED REFERENCE SOURCE AND TARGET DESIGNATOR SYSTEM FOR HIGH-PRECISION GUIDANCE OF GUIDED MUNITIONS

(75) Inventor: Jahangir S. Rastegar, Stony Brook, NY (US)

(73) Assignee: Omnitek Partners LLC, Ronkonkoma, NY (US)

( * ) Notice: Subject to any disclaimer, the term of this patent is extended or adjusted under 35 U.S.C. 154(b) by 279 days.

(21) Appl. No.: 12/470,470

(22) Filed: May 21, 2009

(65) Prior Publication Data

US 2010/0295720 A1 Nov. 25, 2010

(51) Int. Cl.
*F42B 15/01* (2006.01)
*F41G 7/00* (2006.01)
*F42B 15/00* (2006.01)

(52) U.S. Cl. ..... 244/3.19; 244/3.1; 244/3.11; 244/3.15

(58) Field of Classification Search ..... 244/3.1–3.19, 244/3.2–3.3; 89/1.11; 701/1–4, 200, 207, 701/213, 220; 342/61–66, 70–72, 175, 188
See application file for complete search history.

(56) References Cited

U.S. PATENT DOCUMENTS

| | | | | | |
|---|---|---|---|---|---|
| 3,746,280 | A * | 7/1973 | Coxe et al. | 244/3.13 |
| 3,796,396 | A * | 3/1974 | Crovella | 244/3.14 |
| 3,951,358 | A * | 4/1976 | DeLano et al. | 244/3.15 |
| 4,299,360 | A * | 11/1981 | Layton | 244/3.13 |
| 4,314,761 | A * | 2/1982 | Reymond et al. | 244/3.16 |
| 4,333,008 | A * | 6/1982 | Misek | 244/3.16 |
| 4,347,996 | A * | 9/1982 | Grosso | 244/3.16 |
| 4,422,601 | A * | 12/1983 | Chavany et al. | 244/3.13 |
| 4,497,065 | A * | 1/1985 | Tisdale et al. | 244/3.15 |
| 4,641,801 | A * | 2/1987 | Lynch et al. | 244/3.14 |
| 4,967,979 | A * | 11/1990 | Balstad | 244/3.11 |
| 4,967,981 | A * | 11/1990 | Yff | 244/3.21 |
| 5,018,684 | A * | 5/1991 | Allgaier et al. | 244/3.13 |
| 5,259,567 | A * | 11/1993 | Jano et al. | 244/3.11 |
| 5,478,028 | A * | 12/1995 | Snyder | 244/3.11 |
| 5,490,643 | A * | 2/1996 | Jano et al. | 244/3.11 |
| 5,533,692 | A * | 7/1996 | Layton | 244/3.13 |
| 5,685,504 | A * | 11/1997 | Schneider et al. | 244/3.11 |
| 5,708,583 | A * | 1/1998 | Solenne et al. | 701/4 |
| 6,483,455 | B2 * | 11/2002 | Fleury et al. | 342/62 |
| 6,724,341 | B1 * | 4/2004 | Pereira et al. | 342/62 |
| 7,193,556 | B1 * | 3/2007 | Pereira et al. | 342/62 |
| 7,589,663 | B1 * | 9/2009 | Goldman et al. | 342/62 |
| 2001/0004247 | A1 * | 6/2001 | Fleury et al. | 342/62 |

* cited by examiner

*Primary Examiner* — Bernarr Gregory

(57) ABSTRACT

A method for guidance of a moving object towards a target. The method including: providing reference signals from RF reference sources to illuminate RF sensors on the moving object; positioning the RF reference sources to form a reference coordinate system; determining position information designating a position of the target in the reference coordinate system by a forward observer; fixing at least one of the RF reference sources at the forward observer in the reference coordinate system; determining a position and orientation of the moving object in the reference coordinate system on board the moving object based on signals received at the RF sensors from the RF reference sources and based on the positions of the RF reference sources; and guiding the moving object to the target at least based on the determined position and orientation of the moving object and the determined position information of the designated target.

6 Claims, 2 Drawing Sheets

INTEGRATED REFERENCE SOURCE AND TARGET DESIGNATOR SYSTEM FOR HIGH-PRECISION GUIDANCE OF GUIDED MUNITIONS

CROSS-REFERENCE TO RELATED APPLICATIONS

This application is related to U.S. Pat. Nos. 6,724,341 and 7,193,556; U.S. Patent Application Publication 2007/0001051, now U.S. Pat. No. 7,425,998 and U.S. application Ser. No. 11/888,797, filed Aug. 2, 2007 and Ser. No. 12/191,295, filed Aug. 13, 2008, the entire contents of each of which are incorporated herein by reference.

BACKGROUND

1. Field

The present invention relates generally to integrated reference sources and, more particularly, to target designator systems for high-precision guidance of guided munitions.

In this disclosure, the polarized Radio Frequency (RF) reference sources and geometrical cavities as described in U. S. Pat. 6,724,341 and 7,193,556; U.S. patent application Publication 2007/0001051, now U.S. Pat. No. 7,425,998, hereinafter referred to as "polarized RF position and angular orientation sensors" and preferably "scanning polarized RF reference sources" as described in the U.S. Ser. No. 11/888,797, filed Aug. 2, 2007 and Ser. No. 12/191,295, filed Aug. 13, 2008, hereinafter referred to as "RF reference sources," all of which are incorporated herein by reference, are used to form an integrated target designation and reference source system for high precision guidance of guided munitions towards its target.

2. Prior Art

In general, a human or machine (such as an "Unmanned Aerial Vehicle" or UAV, or an "Unmanned Ground Vehicle" or UGV or a manned aerial or ground vehicle, or the like) is used to identify the target. Some means (e.g., one or more of the systems and devices such as "Global Positioning System" GPS, range finders, inertial devices, etc.) are then used to determine the position of the target and other relevant target indication information. Hereinafter, the above human or machine that is used to determine the position of the target is referred to generally as the "forward observer".

In general, the position of the target is determined by the "forward observer" and is indicated relative to the earth. The "forward observer" must also determine its own position relative to the earth. The weapon platform that is to engage the target must also know its own position relative to the earth. The target position and other information that is acquired by the "forward observer" is then passed to the engaging weapon platform fire controller (usually a computer), which would then perform proper computations and pass target position and other guidance and control information to the guided munitions that is to be launched against the designated target. Once launched, the guided munitions will use the target position information (and sometimes target position updates when it is available) to guide itself to the designated target position. Near the target, guided munitions may, when equipped with some type of homing sensors, also use such sensors to guide them to the target.

As indicated above, in most current munitions guidance and control systems, the position of the target is determined by the forward observer relative to the earth, i.e., the earth is considered to be the reference system in which the position of the target, the weapon platform, and the forward observer is defined. In addition, the guided munitions, such as projectiles fired from a gun or a mortar, monitors its position relative to the same earth based (fixed) position reference system. There is, however, an error in each one of the above four position measurement relative to the aforementioned earth fixed reference system. As a result, the four position measurement errors add up to make up the amount of positioning error that the guided munitions can have relative to the target that it is desired to intercept, leading to a significant degradation of the precision with which a target could be intercepted.

In general, the only means available for increasing the precision with which guided munitions can be guided to intercept a desired target is the provision of some type of homing device. Such homing systems may, for example, include target seekers such as heat seeking sensors or various guidance systems utilizing laser designators, etc. Such homing systems usually require sophisticated sensory devices that occupy relatively large spaces onboard and require relatively high onboard power to operate, which make them not suitable for many munitions applications, particularly gun-fired munitions (particularly small and medium caliber munitions) and mortars. In addition, homing systems using various target designators such as laser target designators generally requires a forward target observer, usually a human, to designate the target, which is also generally not a desirable solution.

SUMMARY

A need therefore exists for a method and apparatus that can be used to significantly increase the precision with which a target position can be provided to guide guided munitions without requiring aforementioned or the like seekers.

An object is to provide such a method and apparatus that can be used in munitions, particularly in gun-fired munitions and mortars and rockets, to provide significantly higher precision with which the position of the target is provided to munitions for guidance to intercept a designated target.

Another object is to provide a method and apparatus that allows guided munitions to be provided with target position information that is significantly more precise than those currently available without requiring onboard seekers.

Another object is to provide a method and apparatus that allows guided munitions to be provided with highly precise target position information using the aforementioned polarized RF position and orientation sensors and polarized RF reference sources such that not only the position of the target becomes known to the guided munitions during its flight but information is also provided to the guided munitions as to its orientation relative to the target. The latter orientation information is essential for munitions guidance and control, since by knowing its orientation relative to the target at all times, the guided munitions can perform its guidance maneuvers with minimal control actuation efforts, thereby requiring smaller actuation devices and less power for guidance and control. As a result, less volume will need to be occupied by the latter components, thereby making it possible to provide guidance and control components to munitions without degrading their effectiveness, particularly for smaller caliber munitions.

Accordingly, a method for guidance of a moving object towards a target is provided. The method comprising: (a) providing reference signals from three or more polarized RF reference sources to illuminate three or more polarized RF sensors on a surface of the moving object; (b) positioning the three or more polarized RF reference sources to form a reference coordinate system; (c) determining position information designating a position of the target in the reference coordinate system by a forward observer; (d) fixing at least one of the polarized RF reference sources at the forward observer in the reference coordinate system; (e) determining a position and orientation of the moving object in the reference coordinate system on board the moving object based on signals received at the three or more polarized RF sensors from the three or more polarized RF reference sources and based on the positions of the three or more polarized RF reference sources; and (f) guiding the moving object to the target at least based on the determined position and orientation of the moving object and the determined position information of the designated target.

The fixing step (d) can comprise fixing at least two of the polarized RF reference sources at a forward observer in the reference coordinate system.

The fixing step (e) can comprise fixing at least three of the polarized RF reference sources at a forward observer in the reference coordinate system.

The forward observer can be one or more of a ground human observer, an airborne human observer, a UAV, a UGV and a satellite.

The method can further comprise (g) using GPS data to provide position information corresponding to one or more of the polarized RF reference sources, the forward observer and the moving object.

The method can further comprise (g) using data from one or more inertial sensors on board the moving object to provide additional position and/or orientation measurements for control of the moving object.

BRIEF DESCRIPTION OF THE DRAWINGS

These and other features, aspects, and advantages of the apparatus and methods of the present invention will become better understood with regard to the following description, appended claims, and accompanying drawings where:

DETAILED DESCRIPTION OF THE PREFERRED EMBODIMENT

The aforementioned "polarized RF position and angular orientation sensors" and "polarized RF reference sources" (which can be the aforementioned scanning type of polarized RF reference sources) are used to form a novel integrated target designation and reference source system for high precision guidance of guided munitions towards the designated target.

For example, consider the polarized RF position and angular orientation sensors 100 shown embedded in the moving object (in this case a guided munition in flight) and the RF polarized reference sources 400. The position and orientation of the polarized RF reference sources 400 is considered to be known in the Cartesian coordinate system $X_{ref}Y_{ref}Z_{ref}$, which is preferably fixed to at least one of the polarized RF reference sources 400. The Cartesian coordinate system XYZ is considered to be fixed to the moving object (in this case a guided munition in flight). The position and orientation of the polarized RF position and orientation sensors 100 are therefore known in the Cartesian XYZ coordinate system.

As described in the aforementioned U. S. Pat. Nos. 6,724,341 and 7,193,556 and U.S. Patent application publication number 2007/0001051, now U.S. Pat. No. 7,425,998, by positioning at least three such polarized RF position and orientation sensors 100 on a first object and three such polarized RF reference sources 400 on a second object (forming a reference coordinate system $X_{ref}Y_{ref}Z_{ref}$), the full position and orientation of the first object can be determined relative to the second object, i.e., the position and orientation of the first object can be described fully in the reference coordinate system $X_{ref}Y_{ref}Z_{ref}$.

Figure 1:
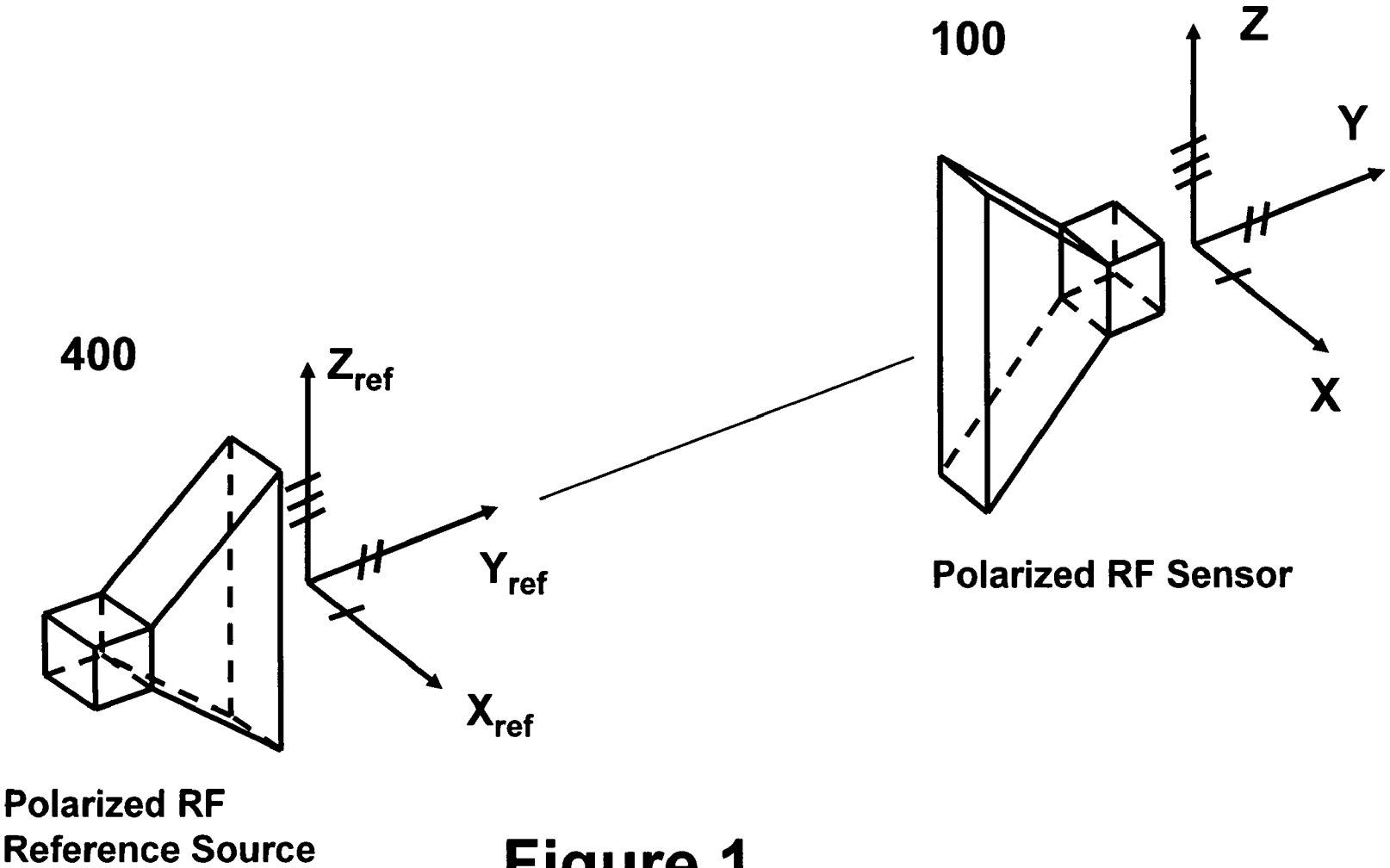
FIG. 1 represents view of the embodiment of an autonomous onboard absolute position and orientation measurement system (sensor) illustrating a polarized RF cavity sensor and a polarized RF reference source.
Figure 2:
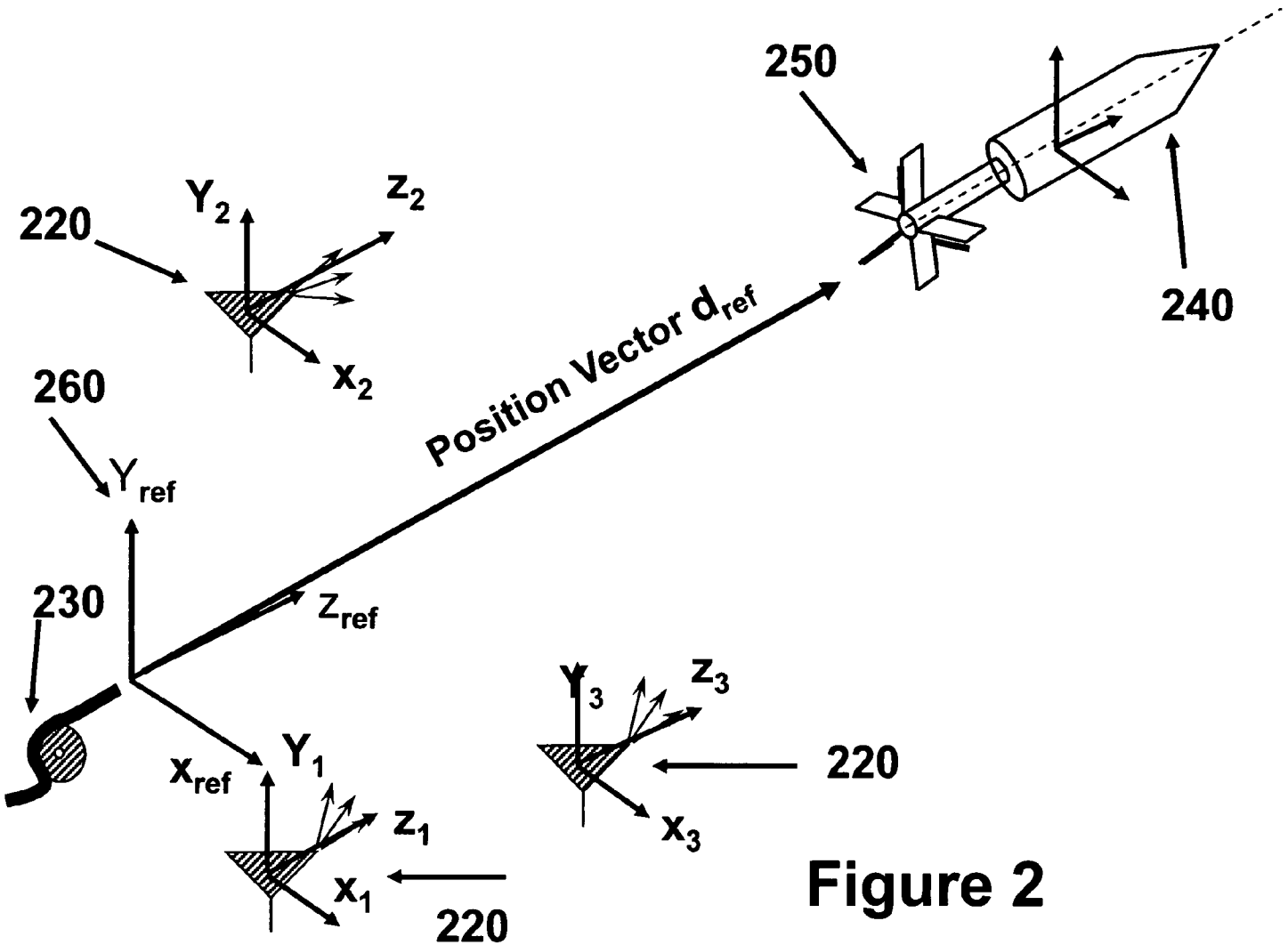
FIG. 2 is an illustration of an autonomous onboard absolute position and orientation measurement system of a first embodiment of the present invention, illustrating a plurality of polarized RF reference sources, shown surrounding a first object (in this case the fixed gun emplacement), to provide temporally synchronized, pulsed or continuous polarized RF reference signals to illuminate a second object (in this case a munition in flight), on which a plurality of polarized RF cavity sensors are embedded (fixed) for providing on-board information about the position and orientation of the second object (a munition in flight) relative to the first object (the fixed gun).

FIG. 2 illustrates the basic method of using the aforementioned polarized RF reference sources and polarized RF cavity sensors for onboard measurement of full position and angular orientation of one object relative to another object. In this method, three or more of, polarized RF reference sources 220, which can be pulsed, provides reference signals, which can be temporally synchronized, that illuminate an object (in this case a projectile such as a munition 240). A minimum of three polarized RF reference sources 220 is required though a greater number increases the accuracy of the onboard position and orientation calculations. A reference coordinate system (in this case a Cartesian coordinate system $X_{ref}Y_{ref}Z_{ref}$, indicated as 260 in FIG. 2) is preferably used, relative to which the position of each polarized RF reference source 220 and the position and orientation of the first object (in this case the gun 230) is known. Three or more polarized RF cavity sensors 250 are embedded in the second object (in this case the projectile 240). The full position and orientation of the second object (the projectile 240) can then be determined onboard the second object 240 relative to the first object (in this case the gun 230). That is, the full position and orientation of the second object 240 (in this case the projectile 240) can be determined onboard the second object 240 in the Cartesian coordinate system $X_{ref}Y_{ref}Z_{ref}$ as described in the aforementioned patents and patent application.

The Cartesian coordinate system $X_{ref}Y_{ref}Z_{ref}$ may be fixed to the first object (in this case the gun 230) as shown in FIG. 2, or in certain cases it may be preferable that it is not fixed to the first object 230 but fixed to the earth, in which case the first object is essentially the earth.

When the above polarized RF reference sources and onboard polarized RF cavity sensors are used to guide a projectile 240 to intercept a target (the position of which is known in the Cartesian coordinate system $X_{ref}Y_{ref}Z_{ref}$), then the aforementioned first object is the Cartesian coordinate system $X_{ref}Y_{ref}Z_{ref}$ or whatever object (usually the earth) to which the Cartesian coordinate system is attached. In general, the reference Cartesian coordinate system $X_{ref}Y_{ref}Z_{ref}$ is considered fixed to the earth since as it was indicated previously, in most current munitions guidance and control systems, the position of the target is determined by a "forward observer" relative to the earth. It is noted that the "forward observer" may be a ground or airborne human observer, a UAV, a UGV, a satellite, or the like. In addition, the position of the weapon platform and the position of the guided munitions are also indicated relative to the earth, i.e., in the reference Cartesian coordinate system $X_{ref}Y_{ref}Z_{ref}$. During the flight, the guidance and control system onboard the munitions would then use the target position information and its own position measurement (both in the reference Cartesian coordinate system $X_{ref}Y_{ref}Z_{ref}$—in this case fixed to the earth) to navigate to intercept the target.

As was previously indicated, a first positioning error exists in the measurement of the position of the "forward observer" in the reference Cartesian coordinate system $X_{ref}Y_{ref}Z_{ref}$, in this case fixed to the earth. A second position error exists in the measurement of the position of the target in the reference Cartesian coordinate system $X_{ref}Y_{ref}Z_{ref}$. A third position error exists in the measurement of the position of the polarized RF reference sources in the reference Cartesian coordinate system $X_{ref}Y_{ref}Z_{ref}$. A fourth position error also exists in the measurement of the position of the munitions during the flight in the reference Cartesian coordinate system $X_{ref}Y_{ref}Z_{ref}$. All these four position measurement errors add up as the navigation and guidance and control system onboard munitions calculates its position relative to the target that it is attempting to intercept.

An objective of the present methods and apparatus is to provide a method and means of significantly reducing the aforementioned amount of error between the actual position of the target and the target position calculated onboard munitions, which is used by the munitions control system to guide the munitions towards the target.

In one embodiment, one of the polarized RF reference sources 220 is fixed to the "forward observer" (for example, to the UAV or UGV used to determine the position of the target or to the device used by a human forward observer to determine the position of the target). In general and for safety reasons, it is preferable to use a UAV or UGV or other types of unmanned devices for this purpose. By fixing one of the polarized RF reference sources 220 to the "forward observer", the position of the target in the reference Cartesian coordinate system $X_{ref}Y_{ref}Z_{ref}$ is measured in the coordinate system established by the polarized RF reference source 220, which is used together with at least two other polarized RF reference sources to establish the reference $X_{ref}Y_{ref}Z_{ref}$ Cartesian coordinate system itself. As a result:

1. The error in the measurement of the position of the polarized reference sources 220 relative to the earth (or any other object to which the reference Cartesian coordinate system $X_{ref}Y_{ref}Z_{ref}$ would otherwise be fixed to) is eliminated from the error between the actual position of the target and the target position calculated onboard munitions.

2. The error in the measurement of the position of the "forward observer" in the reference Cartesian coordinate system $X_{ref}Y_{ref}Z_{ref}$ is significantly reduced since the reference Cartesian coordinate system $X_{ref}Y_{ref}Z_{ref}$ is defined by the polarized RF reference sources 220, one of which is the polarized RF reference source 220 that is fixed to the "forward observer", thereby significantly reducing the error between the actual position of the target and the target position calculated onboard munitions.

3. The error in the measurement of the position of the target in the reference Cartesian coordinate system $X_{ref}Y_{ref}Z_{ref}$ is significantly reduced since the reference Cartesian coordinate system $X_{ref}Y_{ref}Z_{ref}$ is defined by the polarized RF reference sources 220, one of which is the polarized RF reference source 220 that is fixed to the "forward observer" which is used to measure the position of the target, thereby significantly reducing the error between the actual position of the target and the target position calculated onboard munitions.

As a result, the error between the actual position of the target and the target position calculated onboard munitions and used by the munitions guidance and control system to guide it to intercept the target is significantly reduced. As a result, the precision with which the target can be intercepted by the guided munitions is significantly increased.

It is also noted that another advantage of the above embodiment is that the position of the polarized RF reference sources 220 relative to the earth or the gun 230 does not need to be known. It is, however, more efficient and generally requires less munitions maneuvering if the position of the gun 230 relative to the reference Cartesian coordinate system $X_{ref}Y_{ref}Z_{ref}$, i.e., the polarized RF reference sources 220 is known, thereby allowing the fire control system of the gun 230 to fire the munitions towards the selected target as accurately as possible.

In a second embodiment, more than one "forward observers" are used, to each of which a polarized RF reference sources 220 is affixed. It is appreciated that any type of "forward observers" (for example, to the UAV or UGV or a human forward observer or the like) or their combinations may be employed for this purpose. In general and for safety reasons, however, it is preferable to use UAVs or UGVs or other types of unmanned devices for this purpose. By fixing more than one polarized RF reference sources 220 to more than one "forward observers", the position of the target in the reference Cartesian coordinate system $X_{ref}Y_{ref}Z_{ref}$ is measured more accurately in the coordinate system established by the said polarized RF reference sources 220 that together with the remaining polarized RF reference sources establish the reference $X_{ref}Y_{ref}Z_{ref}$ Cartesian coordinate system. As a result, the second and third position measurement errors enumerated above for the first embodiment are further reduced. As a result, the error between the actual position of the target and the target position calculated onboard munitions and used by the munitions guidance and control system to guide it to intercept the target is further reduced. As a result, the precision with which the target can be intercepted by the guided munitions is significantly increased.

In a third embodiment, at least three "forward observers" are used, to each of which a polarized RF reference sources 220 is affixed. In this embodiment, all polarized RF reference sources used to establish the reference Cartesian coordinate system $X_{ref}Y_{ref}Z_{ref}$ are the above polarized RF reference sources 220 that are fixed to the "forward observers". It is appreciated that any type of "forward observers" (for example, to the UAV or UGV or a human forward observer or the like) or their combinations may be employed for this purpose. In general and for safety reasons, however, UAVs or UGVs or other types of unmanned devices can be used for this purpose. By all the polarized RF reference sources 220 being fixed to the "forward observers", the position of the target in the reference Cartesian coordinate system $X_{ref}Y_{ref}Z_{ref}$ is measured very accurately since the coordinate system $X_{ref}Y_{ref}Z_{ref}$ is itself established by the said "forward observer" fixed polarized RF reference sources 220. In addition, the second and third position measurement errors enumerated above for the first embodiment are no longer important in the onboard munitions calculation of the error between the actual position of the target and the target position calculated onboard munitions, which is used by the munitions guidance and control system to guide it to intercept the target. In fact, the latter error is reduced to the level of accuracy with which the "forward observer" can measure the position of the target in the reference Cartesian coordinate system $X_{ref}Y_{ref}Z_{ref}$ and that the munitions can measure its own position in the reference Cartesian coordinate system $X_{ref}Y_{ref}Z_{ref}$. In fact, since the latter two position measurements are made in the same reference Cartesian coordinate system $X_{ref}Y_{ref}Z_{ref}$, this embodiment acts as a homing device that can be used to guide munitions to the designated target. As a result, the precision with which the target can be intercepted by the guided munitions is even further increased.

In a fourth embodiment, either one of the aforementioned embodiments are used together with a GPS device that whenever available would provide position information to the gun 230 and/or polarized RF reference sources 220, and/or the "forward observers", and/or to the munitions 240 (FIG. 2). This position information is mostly redundant and is used to increase the precision with which the aforementioned position information and thereby the error between the actual position of the target and the target position calculated onboard munitions and used by the munitions guidance and control system to guide it to intercept the target are calculated. As a result, the precision with which the target can be intercepted by the guided munitions is even further increased.

In a fifth embodiment, either one of the aforementioned embodiments is used together with onboard inertial sensors such as accelerometers and/or gyros or the like position angular orientation (or rate) sensors to provide added position and/or orientation measurements, particularly at high rates for flight control. These sensors can then be periodically initialized by the onboard munitions measurements of its position and/or orientation by the onboard polarized RF sensors (the position initialization may also be complemented by the GPS when it is available) to correct for the accumulated errors in their measurements. The position and/or orientation information provided by the above inertial or the like sensors are mostly redundant and are used to increase the precision with which the aforementioned position and/or orientation information and thereby the error between the actual position of the target and the target position calculated onboard munitions and used by the munitions guidance and control system to guide it to intercept the target are calculated. As a result, the precision with which the target can be intercepted by the guided munitions is even further increased.

While there has been shown and described what is considered to be preferred embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

What is claimed is:

1. A method for guidance of a moving object towards a target, the method comprising:

(a) providing reference signals from three or more polarized RF reference sources to illuminate three or more polarized RF sensors on a surface of the moving object;

(b) positioning the three or more polarized RF reference sources to form a reference coordinate system;

(c) determining position information designating a position of the target in the reference coordinate system by a forward observer;

(d) fixing at least one of the polarized RF reference sources at the forward observer in the reference coordinate system;

(e) determining a position and orientation of the moving object in the reference coordinate system on board the moving object based on signals received at the three or more polarized RF sensors from the three or more polarized RF reference sources and based on the positions of the three or more polarized RF reference sources; and (f) guiding the moving object to the target at least based on the determined position and orientation of the moving object and the determined position information of the designated target.

2. The method of claim 1, wherein the fixing step (d) comprises fixing at least two of the polarized RF reference sources at a forward observer in the reference coordinate system.

3. The method of claim 1, wherein the fixing step (e) comprises fixing at least three of the polarized RF reference sources at a forward observer in the reference coordinate system.

4. The method of claim 1, wherein the forward observer is one or more of a ground human observer, an airborne human observer, a UAV, a UGV and a satellite.

5. The method of claim 1, further comprising (g) using GPS data to provide position information corresponding to one or more of the polarized RF reference sources, the forward observer and the moving object.

6. The method of claim 1, further comprising (g) using data from one or more inertial sensors on board the moving object to provide additional position and/or orientation measurements for control of the moving object.

* * * * *